US011070003B2

(12) United States Patent
Matsumura et al.

(10) Patent No.: US 11,070,003 B2
(45) **Date of Patent: *Jul. 20, 2021**

(54) CONNECTOR WITH CABLE COVER

(71) Applicant: Yazaki Corporation, Tokyo (JP)

(72) Inventors: Kaoru Matsumura, Shizuoka (JP); Motoyoshi Suzuki, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/815,614

(22) Filed: Mar. 11, 2020

(65) Prior Publication Data

US 2020/0295503 A1 Sep. 17, 2020

(30) Foreign Application Priority Data

Mar. 15, 2019 (JP) ..... JP2019-048527

(51) Int. Cl.
*H01R 13/52* (2006.01)

(52) U.S. Cl.
CPC ..... *H01R 13/5213* (2013.01); *H01R 13/5205* (2013.01); *H01R 13/5227* (2013.01)

(58) Field of Classification Search
CPC ..... H01R 13/5227; H01R 13/5205; H01R 13/5213
See application file for complete search history.

(56) References Cited

U.S. PATENT DOCUMENTS

| | | | | |
|---|---|---|---|---|
| 8,257,101 | B2 * | 9/2012 | Ichio | H01R 13/5227 439/205 |
| 8,662,910 | B2 * | 3/2014 | Ichio | H01R 13/5227 439/206 |
| 8,827,731 | B2 * | 9/2014 | Sasaki | H01R 13/5227 439/205 |
| 9,337,633 | B2 * | 5/2016 | Suzuki | H01R 13/5227 |
| 9,917,396 | B2 * | 3/2018 | Horiuchi | H01R 13/5227 |
| 10,044,133 | B2 * | 8/2018 | Wittrock | H01R 13/5227 |
| 2013/0078846 | A1 * | 3/2013 | Sasaki | H01R 13/5227 439/374 |

FOREIGN PATENT DOCUMENTS

| | | | | |
|---|---|---|---|---|
| EP | 2595254 | A2 * | 5/2013 | H01R 13/5219 |
| JP | H10-199611 | A | 7/1998 | |
| JP | 2002-25684 | A | 1/2002 | |

* cited by examiner

*Primary Examiner* — Tho D Ta
(74) *Attorney, Agent, or Firm* — Sughrue Mion, PLLC

(57) ABSTRACT

A connector with cable cover includes a housing including a terminal accommodation chamber configured to accommodate a terminal connected to a cable and a rear surface configured to draw out the cable from the housing; and a cable cover formed in a tubular shape and attached to a side of the rear surface. A water drain passage is formed between a rear side on a side surface of the housing and a front side on an inner surface of the cable cover in a state where the cable cover is attached to the housing.

1 Claim, 5 Drawing Sheets

CONNECTOR WITH CABLE COVER

CROSS REFERENCE TO RELATED APPLICATION

The present application is based on, and claims priority from Japanese Patent Application No. 2019-048527, filed on Mar. 15, 2019, the entire contents of which are incorporated herein by reference.

TECHNICAL FIELD

The disclosure relates to a connector with cable cover.

RELATED ART

As this type of a connector with cable cover, the connector with cable cover disclosed in JP 2002-25684 A includes a housing having a terminal accommodation chamber in which a terminal connected to a cable is accommodated and a cable is drawn out from a rear surface, and a tubular cable cover attached to a side of the rear surface of the housing. The cable cover has a tubular cover body and a pair of opening and closing members provided on the cover body via a hinge. The rear side of the inner surface of the pair of opening and closing members is provided with a locking section for locking a bellows-like corrugated tube.

SUMMARY

However, in the conventional connector with cable cover, water coming down from the cable or the corrugated tube collects in a hollow groove of the housing, and the water cannot be removed.

An object of the disclosure is to provide a connector with cable cover capable of draining water to the outside even if the water coming down from a cable or the like is going to enter the housing.

The connector with cable cover according to the present embodiment includes a housing including a terminal accommodation chamber configured to accommodate a terminal connected to a cable and a rear surface configured to draw out the cable from the housing; and a cable cover formed in a tubular shape and attached to a side of the rear surface. A water drain passage is formed between a rear side on a side surface of the housing and a front side on an inner surface of the cable cover in a state where the cable cover is attached to the housing.

According to the above configuration, it is possible to provide the connector with cable cover capable of draining water to the outside through the water drain passage even if the water coming down from the cable or the like is going to enter the housing.

DETAILED DESCRIPTION

Various embodiments will be described hereinafter with reference to the accompanying drawings.

A description will hereinafter be given of an embodiment with consultation of drawings.

Figure 1:
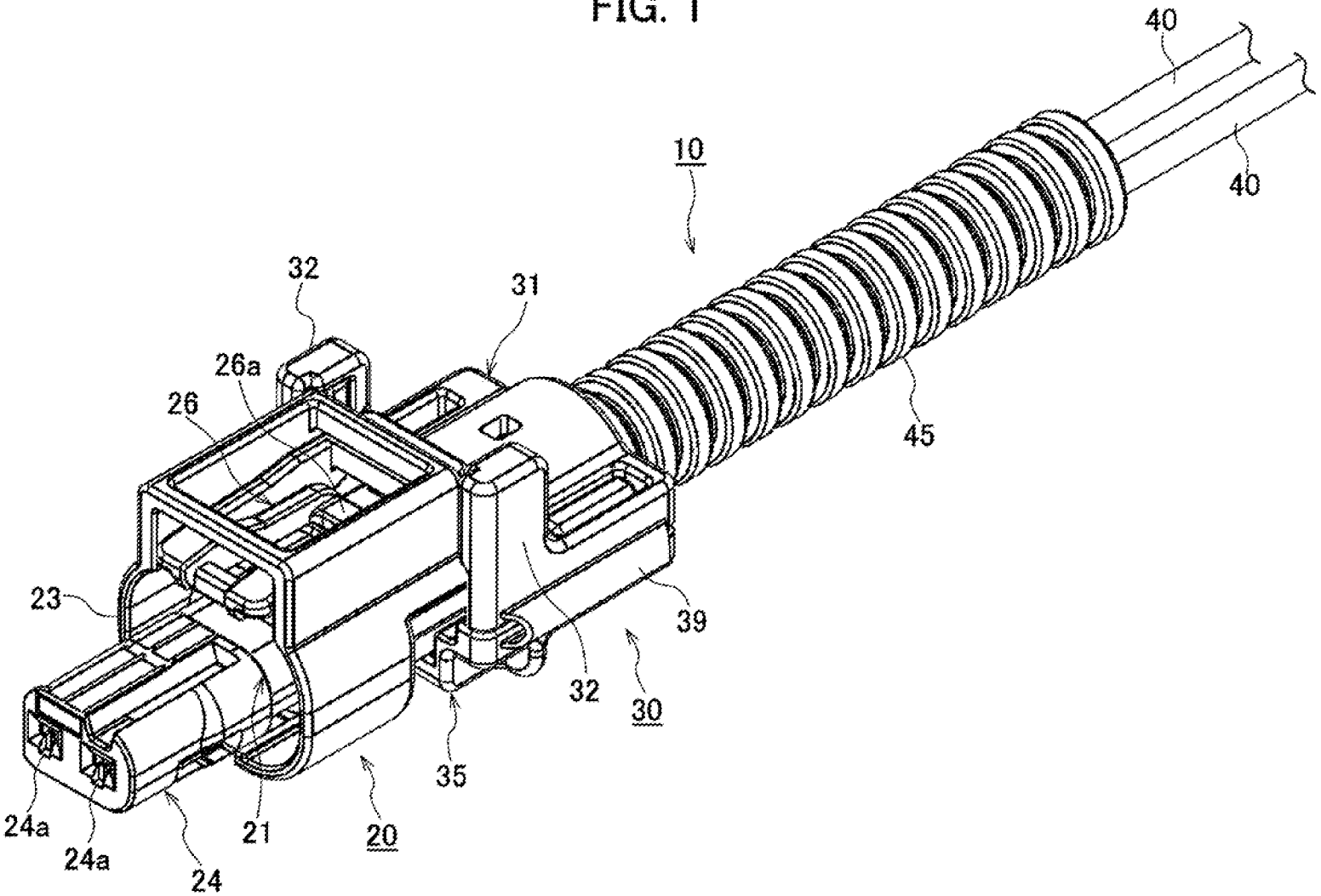
FIG. 1 is a perspective view illustrating a connector with cable cover according to a present embodiment.
Figure 2:
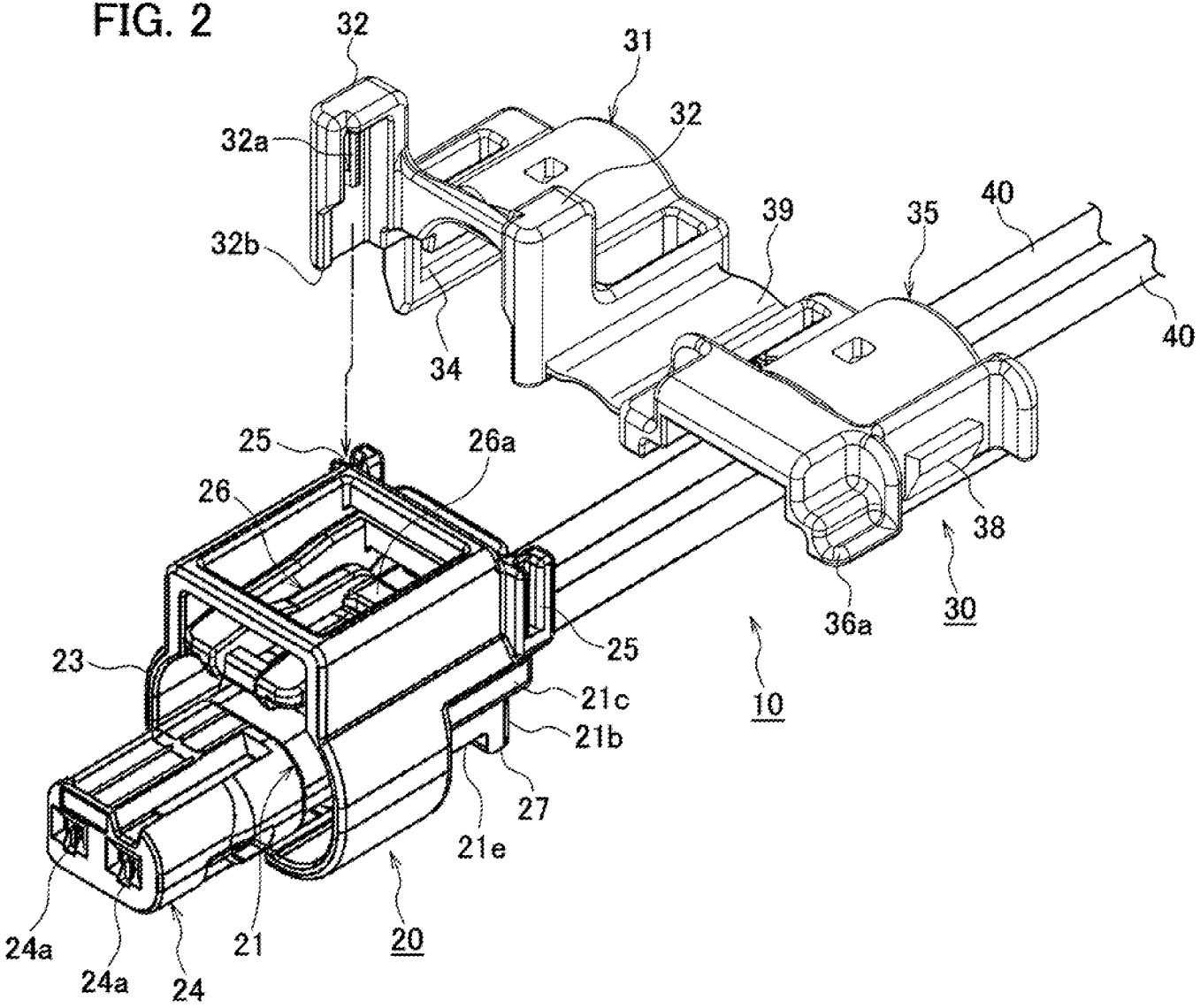
FIG. 2 is a perspective view illustrating a state before the cable cover of the connector with cable cover is attached.
Figure 3:
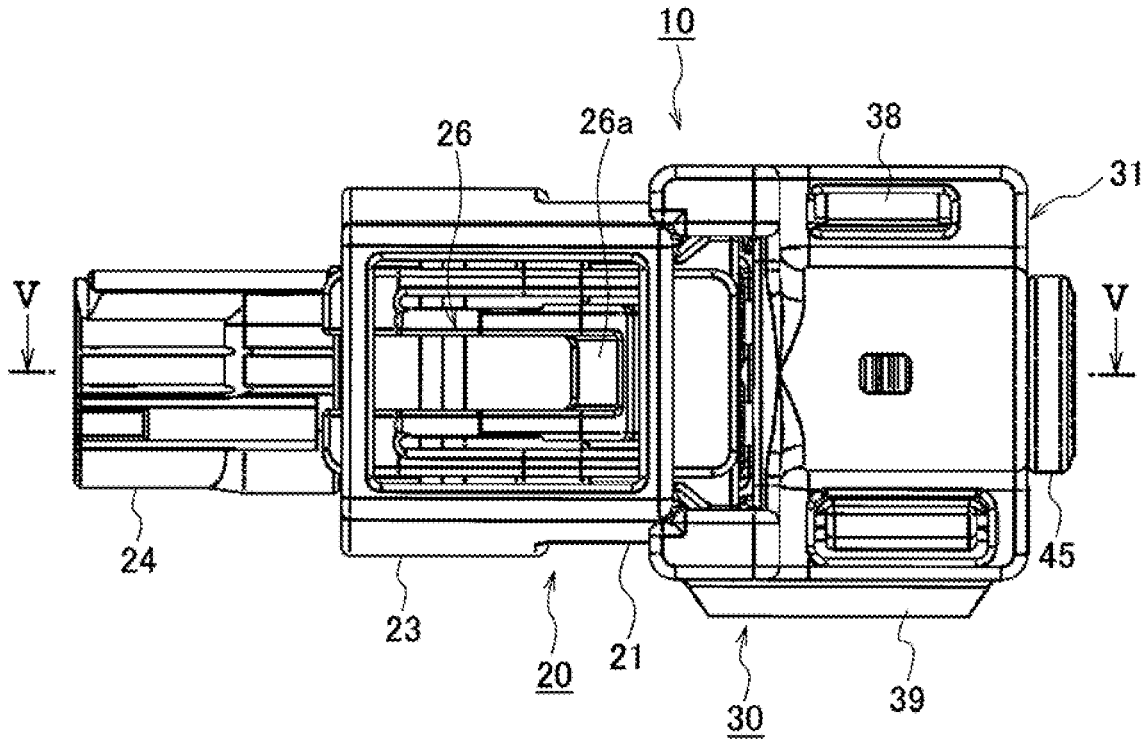
FIG. 3 is a plan view of the connector with cable cover.
Figure 4:
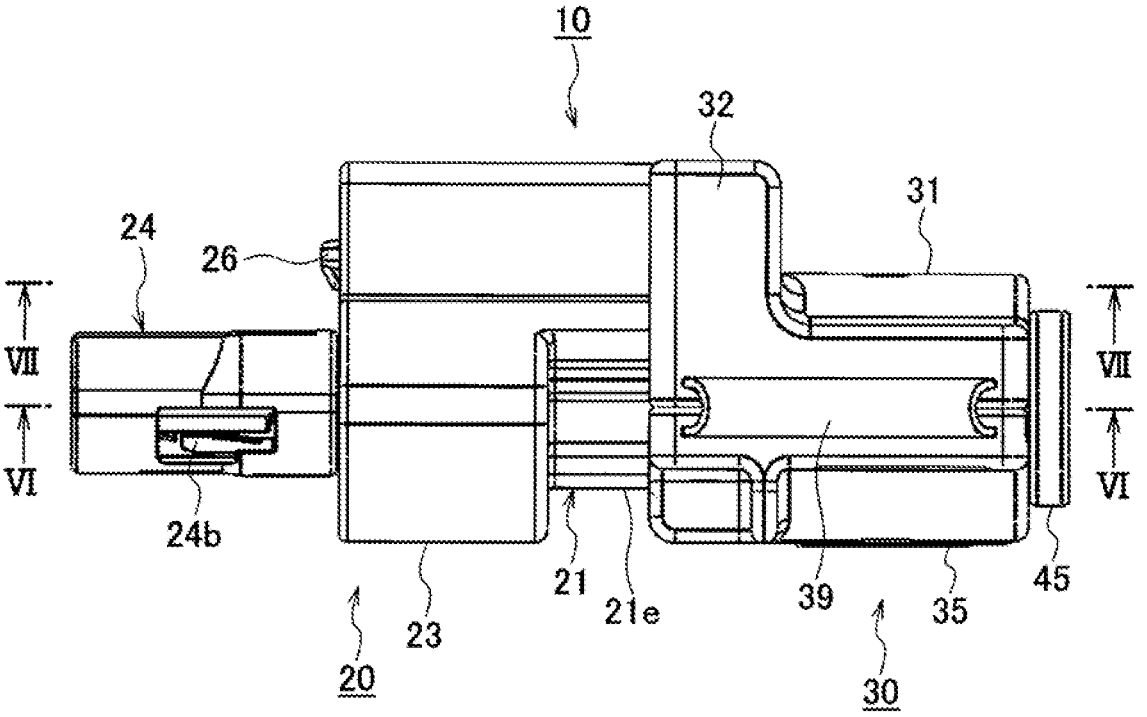
FIG. 4 is a side view of the connector with cable cover.
Figure 5:
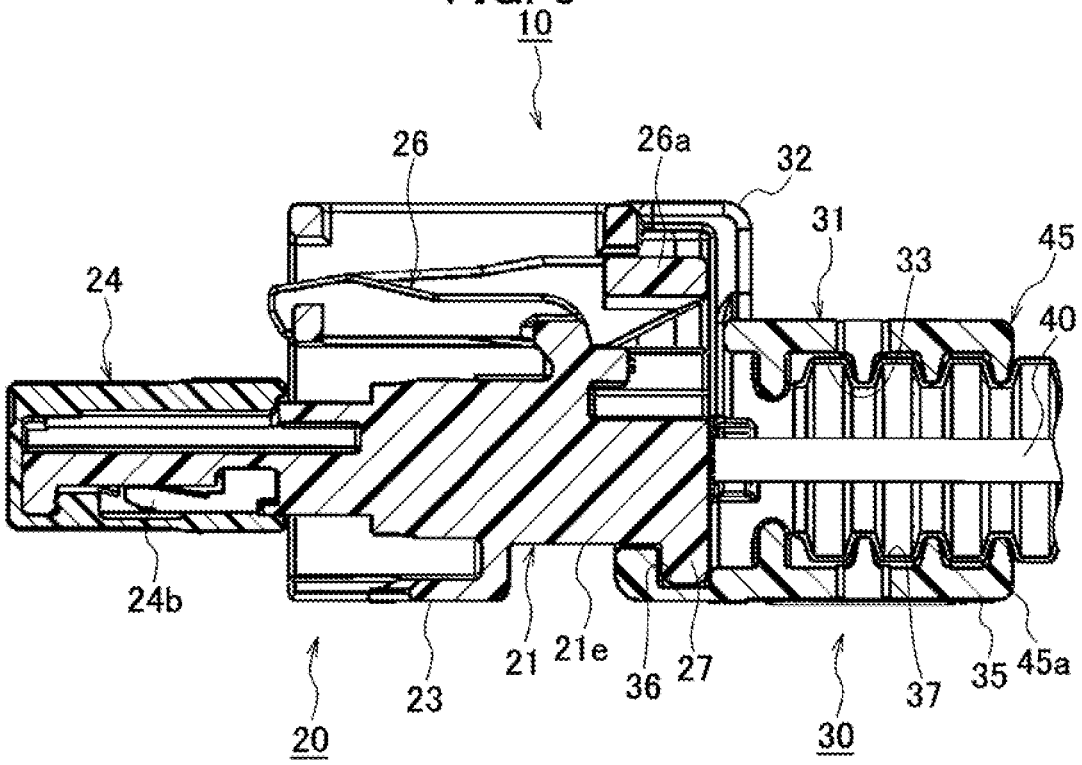
FIG. 5 is a cross-sectional view along a V-V line in FIG. 3.
Figure 6:
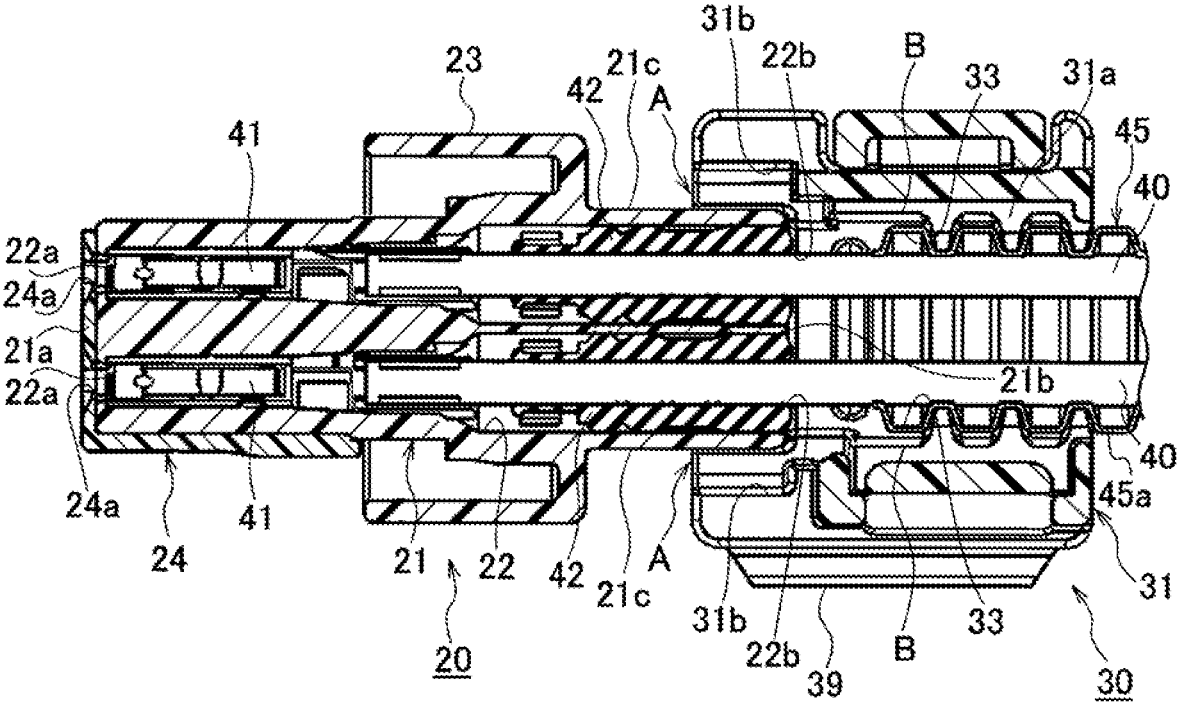
FIG. 6 is a cross-sectional view along a VI-VI line in FIG. 4.
Figure 7:
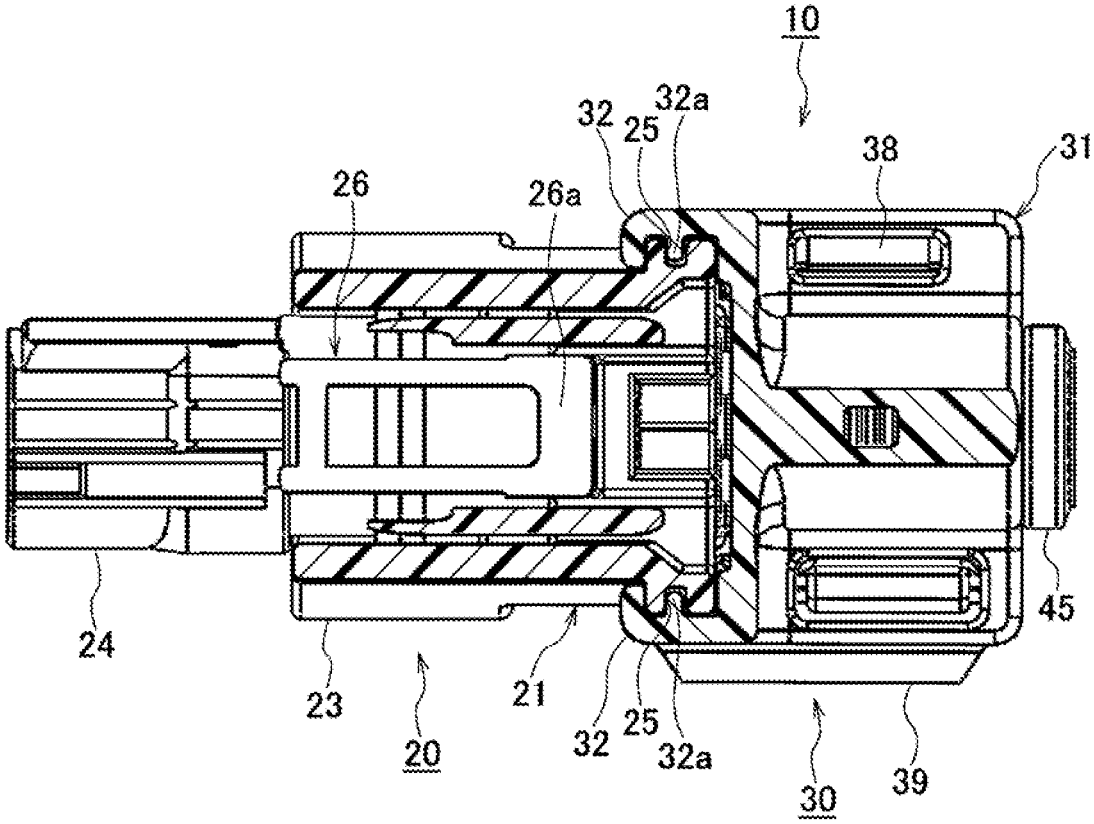
FIG. 7 is a cross-sectional view along a VII-VII line in FIG. 4.

FIG. 1 is a perspective view illustrating the connector with cable cover according to an embodiment of the present invention; FIG. 2 is a perspective view illustrating a state before the cable cover of the connector with cable cover is attached; FIG. 3 is a plan view of the connector with cable cover; FIG. 4 is a side view of the connector with cable cover; FIG. 5 is a cross-sectional view along the V-V line in FIG. 3; FIG. 6 is a cross-sectional view along the VI-VI line in FIG. 4; and FIG. 7 is a cross-sectional view along the VII-VII line in FIG. 4.

For convenience of description, a predetermined direction in a connector 10 with cable cover is defined as the longitudinal direction, a predetermined direction orthogonal to the longitudinal direction is defined as the vertical direction, and a direction orthogonal to the longitudinal direction and the vertical direction is defined as the width direction.

As illustrated in FIGS. 1 to 7, the connector 10 with cable cover includes a synthetic resin female housing (housing) 20 from which a cable 40 is drawn out from a rear surface (back surface) 21*b*, and a synthetic resin tubular cable cover 30 attached to the rear surface 21*b* of the female housing 20. In the present embodiment, the longitudinal direction is a long side of the female housing 20, which is a direction in which the cable 40 to which a female terminal (terminal) is connected is inserted into the female housing 20.

As illustrated in FIGS. 5 and 6, the female housing 20 includes a housing body 21, a hood section 23, and a tubular front holder 24. The housing body 21 has two terminal accommodation chambers 22 in which the female terminal 41 connected to the cable 40 is accommodated. The hood section 23 is formed integrally with the center of the housing body 21 so as to protrude therefrom, and the front surface side and the upper surface side thereof into which a male housing of a male connector of an unillustrated mate is fitted are opened. The tubular front holder 24 is fitted into the front side of the housing body 21, and has a terminal insertion hole 24*a* into which a male terminal of the unillustrated mate is inserted, and a lance 24*b* for locking the female terminal 41.

As illustrated in FIG. 6, the terminal accommodation chamber 22 of the housing body 21 accommodates the female terminal 41 connected to the terminal of the cable 40 from a circular opening 22*b* of the terminal accommodation chamber 22 provided on the rear surface 21*b*. The space between each terminal accommodation chamber 22 and the cable 40 is sealed with a rubber plug 42 mounted to the cable 40. A front surface 21*a* of the housing body 21 is formed with a terminal insertion hole 22*a* into which the male terminal of the unillustrated mate is inserted so as to communicate with the terminal accommodation chamber 22.

As illustrated in FIG. 2, the side of the rear end of both side surfaces 21*c* of the housing body 21 provided in the width direction of the housing 20 is formed with a recessed cover locking groove 25 as a cover locking section. A ceiling surface of the housing body 21 is provided with a lock arm 26 for locking with the male housing of the mate into a fitted state. An operation end 26*a* of the lock arm 26 is provided on the rear side of the upper opening of the hood section 23.

Furthermore, the rear end of a lower surface 21*e* of the housing 20 is provided with a cover attachment projection 27 as a cover attachment section.

As illustrated in FIGS. 1, 2, 5, and 7, the cable cover 30 has a substantially semicylindrical body cover 31, a substantially semicylindrical lid cover 35, and a hinge 39. The substantially semicylindrical body cover 31 is attached to the recessed cover locking groove 25 on the both side surfaces 21*c* of the housing body 21. The substantially semicylindrical lid cover 35 is attached to the cover attachment projection 27 on the lower surface 21*e* of the housing 20 in a tubular state where the substantially semicylindrical lid cover 35 is integrated with the body cover 31, and the substantially semicylindrical lid cover 35 covers the front end side of a corrugated tube 45 through which the cable 40 penetrates. The hinge 39 is provided between the body cover 31 and the lid cover 35.

As illustrated in FIGS. 2 and 5, the front side of the body cover 31 is formed integrally with a pair of attachment sections 32 so as to vertically extend in parallel. The inside of each attachment section 32 is provided with a protruding housing locking projections 32*a* as a housing locking section fitted into the recessed cover locking groove 25 of the housing body 21. An inner surface 31*a* of the body cover 31 is provided with a recessed part 33 locked to a bellows-like protruding part 45*a* of the corrugated tube 45. Furthermore, the end part of the body cover 31 opposite to the hinge 39 is formed with a lock hole 34.

As illustrated in FIG. 6, semicircular stepped recessed parts 31*b* are formed on both front sides of the inner surface 31*a* of the body cover 31 attached on the rear side of the both side surfaces 21*c* of the housing body 21. A gap (clearance) formed between the stepped recessed parts 31*b* of the inner surface 31*a* of the body cover 31 and the both side surfaces 21*c* of the housing body 21 serves as a water drain passage A. The water drain passage A communicates with a gap B between the inner circumferential surface of the recessed part 33 for holding the corrugated tube on the inner surface 31*a* of the body cover 31 and the outer circumferential surface of the corrugated tube 45. Furthermore, since the cable cover 30 is configured so as to be attached to the cover locking grooves 25 provided on the right and left of the housing body 21 of the female housing 20 and the cover attachment projection 27 provided below, in the present embodiment, the gap (water drain passage A) formed between the stepped recessed parts 31*b* of the inner surface 31*a* of the body cover 31 and the both side surfaces 21*c* of the housing body 21 can be provided between the both side surfaces 21*c* of the housing body 21 and the inner surface 31*a* of the body cover 31 of the cable cover 30.

As illustrated in FIG. 5, the front side of an inner surface 35*a* of the lid cover 35 is formed with a recessed housing attachment groove 36 as a housing attachment section fitted into the cover attachment projection 27 of the housing body 21. The inner surface 35*a* of the lid cover 35 is provided with a recessed part 37 locked to the bellows-like protruding part 45*a* of the corrugated tube 45. Furthermore, as illustrated in FIG. 2, the end part of the lid cover 35 opposite to the hinge 39 is provided with a lock projection 38 locked to the lock hole 34. When the body cover 31 and the lid cover 35 are integrated into a tubular shape, a stepped part 36*a* formed in the front part of the outside of the lid cover 35 is fitted into a notch part 32*b* formed on the side of the lower end of the attachment section 32 on the outside of the body cover 31.

According to the connector 10 with cable cover of the embodiment described above, when water enters the rear surface 21*b* side of the housing body 21 of the female housing through the inner circumferential surface of the corrugated tube 45 or the outer circumferential surface of the cable 40, the water does not collect toward the opening 22*b* of the terminal accommodation chamber 22 on the rear surface 21*b* of the housing body 21, and is drained to the outside through the water drain passage A provided between the both side surfaces 21*c* of the housing body 21 and the inner surface 31*a* of the body cover 31 of the cable cover 30. Thereby, water does not collect around the rubber plug 42 in the terminal accommodation chamber 22 of the housing body 21, and the entry of water from the corrugated tube 45 or the cable 40 into the terminal accommodation chamber 22 of the housing body 21 can be reliably prevented.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A connector with cable cover, comprising:

a housing including a terminal accommodation chamber configured to accommodate a terminal connected to a cable and a rear surface configured to draw out the cable from the housing; and a cable cover having a body cover and a lid cover integrated with the body cover into a tubular shape and covering the cable, a stepped recessed part formed on a front side of an inner surface of the body cover and attached to a side of the rear surface of the housing, and a water drain passage formed between the stepped recessed part and a rear side on a side surface of the housing.

* * * * *